US012653325B2

(12) United States Patent
Ye et al.

(10) Patent No.: US 12,653,325 B2
(45) Date of Patent: Jun. 16, 2026

(54) CUSTOMIZED, SPLICED AND MOLDED MATTRESS

(71) Applicant: Tengfei Technology Co., Ltd., Kunshan (CN)

(72) Inventors: Gang Ye, Kunshan (CN); Xianming Mei, Kunshan (CN); Zeng He, Kunshan (CN)

(73) Assignee: Tengfei Technology Co., Ltd., Kunshan (CN)

( * ) Notice: Subject to any disclaimer, the term of this patent is extended or adjusted under 35 U.S.C. 154(b) by 0 days.

(21) Appl. No.: 18/019,100

(22) PCT Filed: Dec. 28, 2022

(86) PCT No.: PCT/CN2022/142875
§ 371 (c)(1),
(2) Date: Feb. 1, 2023

(87) PCT Pub. No.: WO2024/087377
PCT Pub. Date: May 2, 2024

(65) Prior Publication Data

US 2025/0248532 A1 Aug. 7, 2025

(30) Foreign Application Priority Data

Oct. 26, 2022 (CN) ..... 202211317778.6

(51) Int. Cl.
*A47C 27/00* (2006.01)
*A47C 27/14* (2006.01)
(Continued)

(52) U.S. Cl.
CPC ..... *A47C 27/001* (2013.01); *A47C 27/148* (2013.01); *A47C 27/15* (2013.01); *A47C 27/16* (2013.01); *A47C 27/14* (2013.01)

(58) Field of Classification Search
CPC ..... A47C 27/001; A47C 27/14; A47C 27/148; A47C 27/15; A47C 27/16; A61G 7/05715; A61G 7/057
(Continued)

(56) References Cited

U.S. PATENT DOCUMENTS 3,521,311 A * 7/1970 Cohen ..... A47C 27/15 5/727
3,846,857 A * 11/1974 Weinstock ..... A47C 27/15 5/722
(Continued)

FOREIGN PATENT DOCUMENTS

CN 217429639 U * 9/2022
CN 217644895 U * 10/2022
(Continued)

*Primary Examiner* — Robert G Santos
(74) *Attorney, Agent, or Firm* — Rondaus PLLC; George Liu

(57) ABSTRACT

Provided is a customized, spliced and molded mattress, which includes a mattress base layer and a supporting layer, where the supporting layer is disposed on the mattress base layer, at least one supporting area is disposed on the supporting layer, at least one splicing block for changing local elasticity of the supporting area is disposed in the supporting area, and the mattress base layer, the supporting layer and the splicing block are integrally formed by molding. The present disclosure meets the improvement need for elasticity differences in different areas on the mattress by adopting a design that the mattress base layer is integrally formed with the supporting layer with elasticity improvement by molding, so that the mattress has abundant elasticity body feeling. The supporting areas that are formed through the splicing blocks may implement the abundant differential supporting, are applied more skillfully and abundantly, and suitable for customized design and production. A protective covering layer structure formed by once molding is provided, so that
(Continued)

the processing and production for the mattress are more efficient, and the whole molded structure is more reliable and stable.

6 Claims, 2 Drawing Sheets

(51) Int. Cl.
*A47C 27/15* (2006.01)
*A47C 27/16* (2006.01)

(58) Field of Classification Search
USPC ..... 5/722, 727, 728
See application file for complete search history.

(56) References Cited

U.S. PATENT DOCUMENTS 3,885,258 A * 5/1975 Regan ..... A47C 27/16 297/452.37
4,706,313 A * 11/1987 Murphy ..... A47C 27/148 5/737
4,972,535 A * 11/1990 Goldman ..... A47C 27/15 5/736
5,231,717 A * 8/1993 Scott ..... A47C 31/123 5/400
5,671,492 A * 9/1997 Simon ..... A47C 27/15 5/736
2003/0135930 A1* 7/2003 Varese ..... A47C 27/148 5/722
2014/0082843 A1* 3/2014 Papadakos ..... A47C 23/34 5/613
2025/0248532 A1* 8/2025 Ye ..... A47C 27/001

FOREIGN PATENT DOCUMENTS

CN 115568718 A * 1/2023 ..... A47C 27/15
WO WO-8102384 A1 * 9/1981 ..... A47C 23/002
WO WO-2024087377 A1 * 5/2024 ..... A47C 27/15

* cited by examiner

CUSTOMIZED, SPLICED AND MOLDED MATTRESS

TECHNICAL FIELD

The present disclosure relates to a customized, spliced and molded mattress, which belongs to the technical field of molded mattresses.

BACKGROUND

A mattress is a kind of article used between a user and a bed in order to ensure that the user may obtain healthy and comfortable sleeping. There are many mattress materials, and the mattress made of different materials may bring different sleeping effects to the user.

The mattress has many types, including a palm mattress, a latex mattress, a spring mattress, an air inflation mattress, etc. The user usually selects the comfortable mattress according to the hardness and the contact comfort of the mattress.

At present, the mattress on the market is mostly a compound mattress, that is, the compound mattress has a built-in spring layer, a latex layer, a breathable layer and other compound structures. After adopting a layered combination, molding of a covering is implemented by jacket quilting and other modes; and the whole structure is relatively complex, the manufacturing cost is higher, so the mattress is expensive.

On the market, there is still a mattress product compounded in simple layers, such as the palm mattress, the latex mattress and the mattress made of polyurethane material, and this mattress is simple in structure and mostly molded by compressing a single material, and then a simple jacket covering is performed, so as to meet molding needs of the mattress; and this mattress has characteristics of lower cost and convenient production.

However, regardless of the compound mattress or the mattress with the simple layer structure, elastic force of a supporting plane of the mattress is relatively uniform, so as not to meet the need of differential elastic supporting. In addition, the mattress has the jacket covering, which is used to block and protect internal materials, and the molding of the covering is relatively complex, which undoubtedly increases the production cycle and production cost of the mattress.

SUMMARY

The purpose of the present disclosure is to solve the deficiencies in the prior art, and to provide a customized, spliced and molded mattress for a problem that a supporting plane of a traditional mattress has elastic force uniformly distributed.

In order to implement the above purpose, the present disclosure adopts the technical solution below:

a customized, spliced and molded mattress, including a mattress base layer and a supporting layer, where the supporting layer is disposed on the mattress base layer, at least one supporting area is disposed on the supporting layer, and at least one splicing block for changing local elasticity of the supporting area is disposed in the supporting area;

the mattress base layer, the supporting layer and the splicing block are integrally formed by molding.

Preferably, the supporting area is formed by splicing a plurality of splicing blocks.

Preferably, two supporting areas that are spliced are disposed on the supporting layer.

Preferably, by bonding, the supporting layer is integrated with the mattress base layer, the splicing blocks in any supporting area are integrated with each other, and the two supporting areas are integrated with each other.

Preferably, the supporting layer is formed by splicing at least two materials with different elastic force.

Preferably, a top compound surface layer is disposed at a top of the supporting layer, a bottom compound surface layer is disposed at a bottom of the mattress base layer, and the top compound surface layer, the supporting layer, the mattress base layer and the bottom compound surface layer are integrated by molding, so as to form a complex;

a splicing outer contour is disposed at a periphery of the complex, and the splicing outer contour is formed by compressing the top compound surface layer and the bottom compound surface layer.

Preferably, a molded concave-convex structure is disposed at a top of the complex.

The beneficial effects of present disclosure are mainly reflected as follows:

1. The improvement need for elasticity differences in different areas on the mattress is met by adopting a design that the mattress base layer is integrally formed with the supporting layer with elasticity improvement by molding, so that the mattress has abundant elasticity body feeling.

2. The supporting areas that are formed through the splicing blocks may implement the abundant differential supporting, are applied more skillfully and abundantly, and suitable for customized design and production.

3. The protective covering layer structure formed by once molding is provided, so that the processing and production for the mattress are more efficient, and the whole molded structure is more reliable and stable.

BRIEF DESCRIPTION OF THE DRAWINGS

By reading the detail descriptions made to non-restrictive embodiments with reference to the following drawings, other features, purposes and advantages of the present disclosure will be more obvious.

DETAILED DESCRIPTION OF THE EMBODIMENTS

Figure 1:
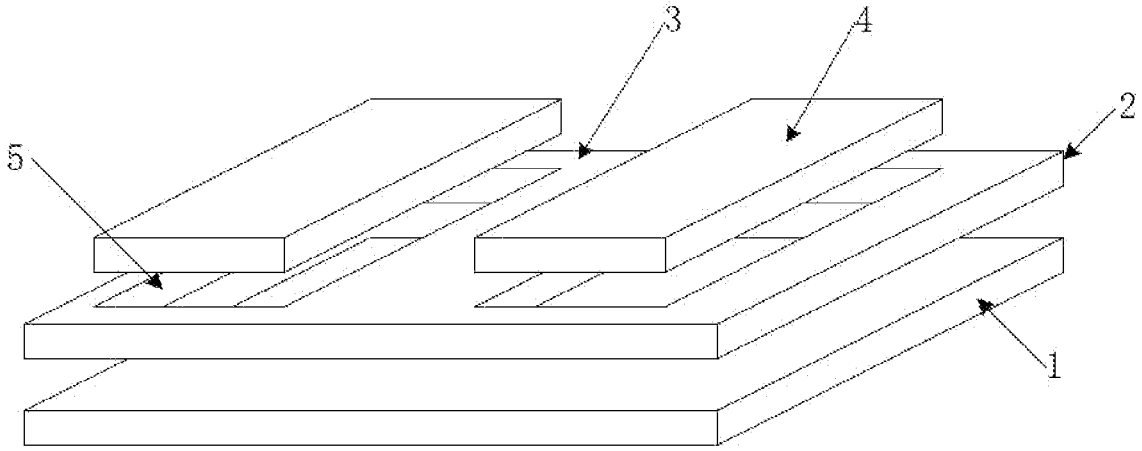
FIG. 1 is a structural schematic diagram of a customized, spliced and molded mattress in Embodiment I of the present disclosure.

In order to make the objectives, technical solution and advantages of the present disclosure clearer, the technical solutions in the embodiments of the present disclosure are clearly and completely elaborated below in combination with the drawings. It is apparent that the described embodiments are a part of the embodiments of the present disclosure but not all. Based on the embodiments of the present disclosure, all the other embodiments obtained by those of ordinary skill in the art on the premise of not contributing creative effort should belong to the protection scope of the present disclosure.

The present disclosure is further described below in combination with drawings and embodiments. It is understood that the specific embodiments described herein are merely used to explain the related invention, instead of limiting the invention. In addition, it also needs to note that, for easy description, some parts related to the invention are only illustrated in the drawings. It is noted that embodiments in the present disclosure and features in the embodiments may be combined with each other without conflict.

The present disclosure provides a customized, spliced and molded mattress, as shown in FIG. 1 to FIG. 4, the mattress includes a mattress base layer 1 and a supporting layer 2, where the supporting layer 2 is disposed on the mattress base layer 1, at least one supporting area 3 is disposed on the supporting layer 2, at least one splicing block 4 for changing local elasticity of the supporting area is disposed in the supporting area 3, and the mattress base layer 1, the supporting layer 2 and the splicing block 4 are integrally formed by molding.

Specific Implementation Process and Principle Description:

In the prior art, the molded mattress is directly molded through a single layer or a plurality of layers, which are designed as a single material and a single thickness, and therefore the elastic force of the mattress is more uniform after molding.

In the present disclosure, the molded structure of the mattress base layer 1, the supporting layer 2 and the splicing blocks 4 is adopted, so as to meet the need of once molding. Belonging to the prior art, the molding is not repeated herein. The molding is mainly used for mass molding and has higher production efficiency, and at the same time, the cost is lower compared with the traditional compound mattress.

In the present disclosure, the property of the mattress base layer 1 is the supporting structure of the mattress, which mainly ensures a certain structural strength and hardness of the mattress, is not easy to generate a greater deformation during a handling and turnover process, and at the same time provides an elastic force supporting basis for the supporting layer 2.

However, the supporting layer 2 is a layered structure for supporting human bodies, and processes excellent elastic and rebound characteristics, so as to meet the need of using comfort. In the present disclosure, the design with the at least one splicing block 4 is adopted, so that the local elasticity in the supporting area 3 may be improved, thereby meeting the adjusting need of specific contact elasticity.

Embodiment I

As shown in FIG. 1, a supporting layer 2 is provided with a hollow portion 5 which is used to carry a splicing block 4, and the splicing block 4 is carried in the hollow portion 5, so as to implement the construction and local elasticity improvement of a supporting area 3 with a whole structure.

The main materials of the splicing block 4 and the supporting layer 2 are the same or different. When adopting the same material, the splicing block 4 adopts different thickness differences to implement the local elasticity change, that is, after hot molding, the whole supporting plane is a molded plane, and at this time a porosity of the splicing block 4 is compressed or released, thereby changing the elasticity of the splicing block 4.

Through a detail description, it can be known that, from FIG. 1, the splicing block is mainly used to improve the supporting elasticity of a head, a neck, a back and hips, and thus the comfort is improved.

Of course, there are various supporting needs for user sleeping and lying, and the corresponding customized arrangement may be performed according to the using habits of the user, so as to greatly meet the customized needs for elasticity and comfort.

Embodiment II

Figure 2:
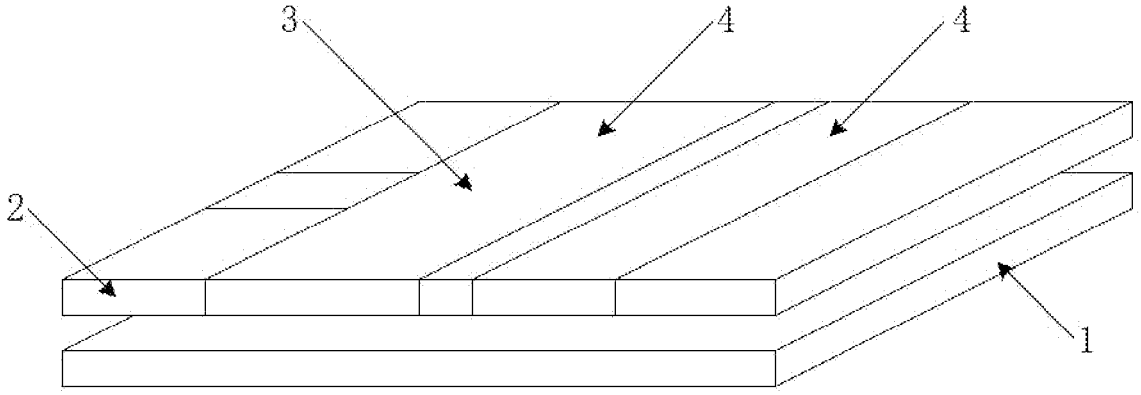
FIG. 2 is a structural schematic diagram of a customized, spliced and molded mattress in Embodiment II of the present disclosure.

As shown in FIG. 2, a supporting area 3 is formed by splicing a plurality of splicing blocks 4. Moreover, the supporting layer 2 is formed by splicing at least two materials with different elastic force. That is, the splicing blocks 4 exist elastic difference.

That is, the whole supporting area 3 is formed by splicing the plurality of splicing blocks 4, so as to form a headrest area, a backrest area, a waist cushion area, a hip cushion area, a leg cushion area and the like, and thus the cooperation of the elastic difference is more abundant.

Each splicing block 4 may adopt a high rebound sponge, a low rebound sponge and the like, or select bionic honeycomb cotton, latex, TPE, a carbon fibre structure, a biological fibre structure and the like, and the splicing combinations that need to meet the change of local elasticity are all within the protection scope of the present disclosure.

Embodiment III

Figure 3:
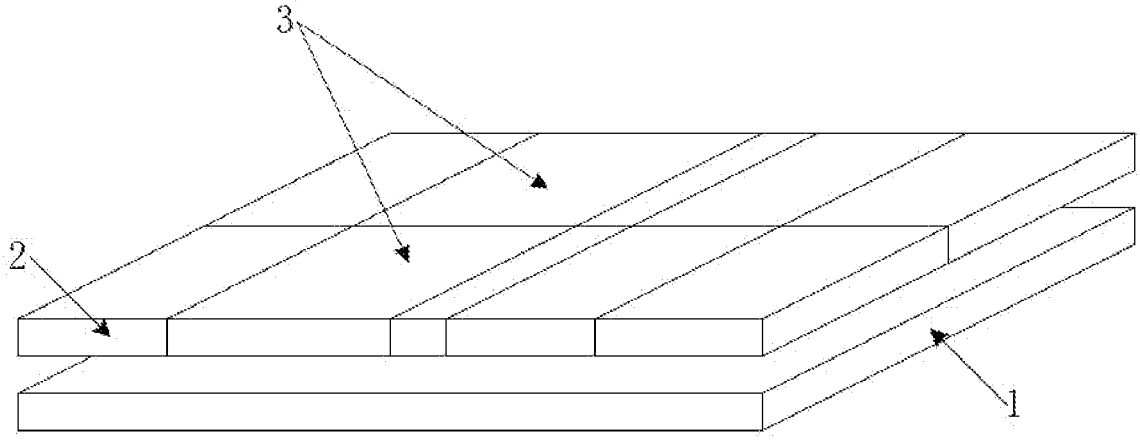
FIG. 3 is a structural schematic diagram of a customized, spliced and molded mattress in Embodiment III of the present disclosure.

As shown in FIG. 3, two supporting areas 3 that are spliced are disposed on a supporting layer 2.

Specifically, a mattress includes a single-bed mattress and a double-bed mattress. Generally, one supporting area 3 corresponds to a supporting position of a single person, and two supporting experiences for sleeping and lying can be provided by combining the differentiated supporting areas 3, so the elasticity experience of the mattress is more abundant, specifically the mattress is suitable for customized production.

In a specific embodiment, by bonding, the supporting layer 2 is integrated with a mattress base layer 1, splicing blocks 4 in any supporting area 3 are integrated with each other, and the two supporting areas 3 are integrated with each other.

It is noted that, generally, the mattress base layer 1 and the supporting layer 2 all adopt materials with hot molding binding force, such as polyurethane and other materials. When the material without the hot melting binding force is selected as splicing blocks 4, adhesion force among composition structures of the splicing blocks 4 may be given through hot melting adhesive, etc.

Embodiment IV

Figure 4:
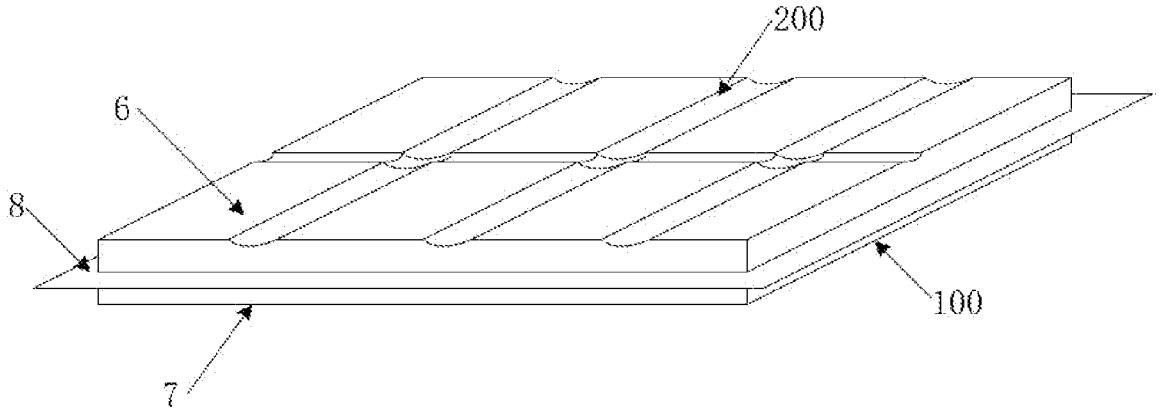
FIG. 4 is a structural schematic diagram of a customized, spliced and molded mattress in Embodiment IV of the present disclosure.

As shown in FIG. 4, a top compound surface layer 6 is disposed at a top of a supporting layer 2, a bottom compound surface layer 7 is disposed at a bottom of a mattress base layer 1, and the top compound surface layer 6, the supporting layer 2, the mattress base layer 1 and the bottom compound surface layer 7 are integrated by molding, so as to form a complex 100.

A splicing outer contour 8, which is formed by compressing the top compound surface layer 6 and the bottom compound surface layer 7, is disposed at a periphery of the complex 100.

Specifically, the complex 100 is an inner core structure formed by the mattress. Generally, a finished product can be manufactured by quilting a covering and other operations.

In the present disclosure, an integrated molding mode of the top compound surface layer 6 and the bottom compound surface layer 7 is adopted. When forming in the inner core, the molding of the covering composed of the top compound surface layer 6 and the bottom compound surface layer 7 may be implemented, and the splicing outer contour 8 is formed, so as to form a whole integrated mattress.

Of course, during an actual molding process, a convex splicing outer contour or a concave splicing outer contour structure may be adopted, and exposed parts may be protected by an edge covering structure. The concave structure may be turned up before molding, so that a turned edge is embedded into a gap between the mattress base layer 1 and the supporting layer 2.

In a specific embodiment, a molded concave-convex structure 200 is disposed at the top of the complex 100. The illustration of the structure is omitted in the drawing, and this structure belongs to the prior art. However, when applied in the present disclosure, the structure can not only provide a certain touch feeling difference, but also implement a certain form setting of splicing seams, so that the surface is more regular and beautiful.

Through the above description, it can be found that the customized, spliced and molded mattress meets the improvement need for elasticity differences in different areas on the mattress by adopting a design that the mattress base layer is integrally formed with the supporting layer with elasticity improvement by molding, so that the mattress has abundant elasticity body feeling. The supporting areas that are formed through the splicing blocks may implement the abundant differential supporting, are applied more skillfully and abundantly, and suitable for customized design and production. The protective covering layer structure formed by once molding is provided, so that the processing and production for the mattress are more efficient, and the whole molded structure is more reliable and stable.

The term "include" or any other similar words are intended to cover nonexclusive inclusions herein, so that a process, method, goods or equipment/device including a series of elements not only includes those elements but also includes other elements which are not clearly listed or further includes elements intrinsic to the process, the method, the goods or the equipment/the device.

So far, the technical solution of the present disclosure has been described in combination with preferred embodiment modes shown in drawings. However, those skilled in the art can easily understand that the protection scope of the present disclosure is obviously not limited to these specific implementation modes. Those skilled in the art can make equal modification or replacement to the related technical features without departing from the principles of the present disclosure; and these modified or replaced technical solutions all fall into the protection scope of the present disclosure.

What is claimed is:

1. A customized, spliced and molded mattress, comprising:

a mattress base layer and a supporting layer, wherein the supporting layer is disposed on the mattress base layer, at least one supporting area is disposed on the supporting layer, and at least one splicing block for changing local elasticity of the at least one supporting area is disposed in the supporting area; and the mattress base layer, the at least one supporting layer and the at least one splicing block are integrally formed by molding; wherein a top compound surface layer is disposed at a top of the supporting layer, a bottom compound surface layer is disposed at a bottom of the mattress base layer, and the top compound surface layer, the supporting layer, the mattress base layer and the bottom compound surface layer are integrated by molding, so as to form a complex; and a splicing outer contour is disposed at a periphery of the complex, and the splicing outer contour is formed by compressing the top compound surface layer and the bottom compound surface layer.

2. The customized, spliced and molded mattress according to claim 1, wherein the at least one supporting area is formed by splicing a plurality of splicing blocks.

3. The customized, spliced and molded mattress according to claim 2, wherein two supporting areas that are spliced are disposed on the supporting layer.

4. The customized, spliced and molded mattress according to claim 3, wherein by bonding, the supporting layer is integrated with the mattress base layer, splicing blocks in any supporting area are integrated with each other, and the two supporting areas are integrated with each other.

5. The customized, spliced and molded mattress according to any one of claim 1, wherein the supporting layer is formed by splicing at least two materials with different elastic force.

6. The customized, spliced and molded mattress according to claim 1, wherein a molded concave-convex structure is disposed at a top of the complex.

* * * * *